US005293206A

United States Patent [19]

Ichihashi et al.

[11] Patent Number: 5,293,206

[45] Date of Patent: Mar. 8, 1994

[54] COLOR IMAGE FORMING APPARATUS WITH OPTIUM OPERATION OF DEVELOPING DEVICE POSITIONING MECHANISM

[75] Inventors: Takao Ichihashi, Osaka; Syuji Yamada, Hyogo; Masashi Matsumoto, Osaka; Mayumi Uramoto, Nara; Yasuyuki Fukunaga, Oskak, all of Japan

[73] Assignee: Mita Industrial Co., Ltd., Osaka, Japan

[21] Appl. No.: 589,175

[22] Filed: Sep. 26, 1990

[30] Foreign Application Priority Data

Jul. 11, 1989 [JP] Japan ..... 1-289679
Sep. 19, 1989 [JP] Japan ..... 1-256665

[51] Int. Cl.[5] ..... G03G 15/01
[52] U.S. Cl. ..... 355/326 R; 355/208
[58] Field of Search ..... 355/326, 327, 208, 203, 355/204, 245

[56] References Cited

U.S. PATENT DOCUMENTS

| | | | |
|---|---|---|---|
| 4,713,673 | 12/1987 | Kessoku | 355/300 X |
| 4,728,987 | 3/1988 | Diola et al. | 118/645 X |
| 4,743,938 | 5/1988 | Ohno | 355/327 |
| 4,891,672 | 1/1990 | Takagi | 355/326 X |
| 4,894,684 | 1/1990 | Nakajima et al. | 355/326 X |
| 4,939,548 | 7/1990 | Yamada et al. | 355/326 X |
| 5,014,095 | 5/1991 | Yamada | 355/208 X |

*Primary Examiner*—Lincoln Donovan
*Assistant Examiner*—Christopher Horgan
*Attorney, Agent, or Firm*—Koda and Androlia

[57] ABSTRACT

An image forming apparatus so composed that it can be furnished with a plurality of developers, can change the developer opposed to the photosensitive body by integrally moving the corresponding developers and can compensate for the position of the corresponding developer at the compensating position thereof while changing developers. Furthermore, in the image forming apparatus, the developers are moved by a motor, the position of the developers is only compensated for when the predetermined compensating position is on a shortest moving path when changing one of the developers to another developer and the developers are always changed through the shortest moving path.

3 Claims, 7 Drawing Sheets

DRUM
7
C
M
Y
BK
8
8x
10
11
12
13
14
15
I PITCH
0.5PITCH
HOME POSITION

COLOR IMAGE FORMING APPARATUS WITH OPTIUM OPERATION OF DEVELOPING DEVICE POSITIONING MECHANISM

BACKGROUND OF THE INVENTION

1. Field of the Invention

The present invention relates to an image forming apparatus of, for instance, a copying machine or a laser beam printer, etc. which is provided with a plurality of developers.

2. Description of the Prior Art

General speaking, a developer for each of the colors is placed in the developer system installed in a color image forming apparatus of, for instance, a copying machine or a laser beam printer, etc. Various kinds of systems have been adopted conventionally as to configuration of arrangement of these developers. Such configurations are usually divided into two large groups, one of which is a fixed developer system and the other of which is a movable developer system.

In the fixed developer system, as developers corresponding to each of the colors are fixed, a moving mechanism for these developers is not needed. However, it is necessary to increase the drum diameter of a photosensitive drum in order to secure a large enough space for arranging the developers in the vicinity of the photosensitive drum. Also, as the developing position opposite to the photosensitive drum differs according to each of the colors, the composition of these developers is subjected to some limitation, and there is a disadvantage that common use of these developers can not be attempted to be accomplished.

On the other hand, in a movable developer system in which each of the developers is subjected to make rotary movements or linear movements, it is possible to adopt a photosensitive drum having a comparatively small diameter as well as for black and white development, and there is and advantage that common use of the developers can be accomplished in each of the colors.

According to the above reasons, recently, a movable developer system has been often adopted. As one of the conventional examples of such a movable developer system as explained in the above, such a configuration, in which each of the developers is integrally linearly moved, so as to be opposed to the photosensitive drum is shown in FIG. 7. A developer device 60 of a color copying machine shown here in this FIG. 7 is such a type as can duplicate with four full colors, in which a magenta-color developer 61, a cyan-color developer 62, a yellow-color developer 63 and a black developer 64 are longitudinally placed and arranged from the above in this order. As these four developers 61 through 64 are integrally driven vertically, each of the developers is changed by turns, opposed to the photosensitive body of photosensitive drum 65, thereby causing an electrostatic latent image on the photosensitive drum 65 to be developed.

The developers are so composed that the position thereof can be compensated at an appointed compensating position on the way of a movement so as to be accurately opposed to the photosensitive drum 65, thereby causing such an abnormality as "imbalance or unevenness of the developing density" of an image obtained by the above development processing to be prevented.

In the conventional image forming apparatus, a usual AC motor or DC motor has been used as motor of the moving mechanism for moving the developers. And only in the case that only such a motor as described in the above is used, the positioning accuracy pertaining to the developers is not good. Hence, in order to heighten the positioning accuracy, a mechanical stopper mechanism is further added.

In the case that such a mechanical stopper mechanism is not added, it can be considered that in order to make the position compensating more accurate a developer is changed after the same developer moves to a compensating position and the position thereof is compensated whenever changing one developer to the other one.

In an image forming apparatus furnished with such a conventional mechanical stopper mechanism as explained in the above, as a stop mechanism is needed in addition to the motor, the cost of production is increased. Additionally, as the positioning of the developer relies upon a mechanical braking force, the positioning accuracy pertaining to the developers will be worsened as the moving speed of the developers is accelerated.

In a method in which position compensating is carried out every time when one of the developers is changed to the other, unnecessary time for moving to the compensating the position of the developers is needed. Therefore, in the conventional image forming apparatus, it is difficult to use a method for compensating the position of developers whenever changing the developers as explained in the above.

On the other hand, in the case that continuous copying of four full colors is carried out in a developer unit of such a linear moving type as mentioned above, development is carried out by changing the developing colors in an appointed cycle of magenta-color→cyan-color→yellow-color→black→magenta-color→ . . . as the characteristics of the constituents of the developing agents is taken into consideration. In the case that such reciprocatory movements of the developers mentioned above are performed, the opposed position of the photosensitive drum must move from black to magenta-color, leaping over cyan-color and yellow-color, and the moving distance in this case will become equivalent to three times the pitch of the developers (three pitches), wherein one pitch is equal to the distance between two neighboring developers.

Hence, in the case that the reciprocatory moving system is employed, the time necessary for changing from a certain color developer to the next color developer must be set to the same period of time in order to facilitate the control system thereof. Therefore, in order to make the period of the moving time required for the three pitches of the developers almost same as that of the moving time required for another pitch, a motor of large capacity will be needed so that it can rotate at a high speed. On the other hand, in the case that the period of the moving time for another pitch is set in accordance with the period of the moving time for three pitches of the developers by using a small-sized motor, the total period of the moving time will be lengthened, thereby causing high speed development to become impossible.

On the other hand, there is another system in which a plurality of developers is moved rotatably, as another example of the moving type developer system. In this developer system, even when the developing color is changed from black to magenta-color as shown in the above, the period of the moving time is enough with one pitch, and such a difficulty as mentioned above does not result therefrom. But in the case that the rotary moving system is adopted, it becomes difficult to supplement toner to the developers which are in each of the positions thereof, and as developers of rotary moving system rotates endlessly, the contacts of the electric system thereof become very complicated. Also, a developer may be turned upside down. Therefore, another difficulty for taking a countermeasure thereagainst results therefrom.

SUMMARY OF THE INVENTION

The present invention has been made for overcoming the aforementioned difficulties of the conventional arts.

It is therefore the first object of the invention to provide an image forming apparatus by which high quality images can be formed by heightening the positioning accuracy of developers without some extra moving time.

Namely, the invention provides an image forming apparatus so composed that it can be furnished with a plurality of developers, can change the developer opposed to the photosensitive body by integrally moving the corresponding developers and can compensate the position of the corresponding developer at the compensating position thereof during changing of the developer opposed to the photosensitive body, is characterized in that the corresponding developer is moved by a positioning motor (a positionable motor), the position of the developer is compensated only in the case that the appointed compensating position is on the shortest moving path when one of the above developers is changed to another developer, and the developers are changed through the shortest moving path.

For instance, in the image forming apparatus, a stepping motor or a DC servo motor can be used as a positionable motor.

For example, in an image forming apparatus according to the invention, as the developers can be moved by a positionable motor, the positioning motor itself is rotated and controlled with a very high accuracy. For this reason, the positioning accuracy by the motor can be heightened in comparison with the conventional system.

Also, as the position of the developer is compensated only in the case that the appointed compensating position is on the shortest moving path when changing one developer to another developer, any positioning error can be compensated even though it results from such mechanical factors as gears and backlashes, thereby causing the positioning accuracy of the developers to be maintained at a high level.

Therefore, the above image forming apparatus can form a high quality image. And as the the position of the developer is compensated on the shortest moving path, this position compensating does not include any wasted time and can be carried out at once.

It is the second object of the invention to provide an image forming apparatus equipped with such a developer system as a plurality of developers are arranged in a row in one direction, by which the moving time of color developers can be shortened and high speed image processing can be performed together with attempting to reduce the size of a moving motor by lightening the load of the moving motor.

Namely, the invention provides an image forming apparatus so composed that it can be furnished with color developers of "n" ("n" being a number more than 4) sets, which are arranged in a row in one direction, a color developer opposed to a photosensitive body can be changed over by moving the corresponding color developer, and color image of a document can be formed on a transfer sheet by controlling the moving sequence of the color developers of "n" sets is characterized in that the color developers of "n" sets can be arranged according to the moving sequence so that the moving distance of each of the color developers can be of "n−2" pitches at maximum.

For instance, in an image forming apparatus according to the invention, color developers of "n" sets arranged in a row in one direction reciprocatorily move with the moving sequence thereof controlled by the moving control means. At this time, as the color developers of "n" sets are so arranged that the moving pitch thereof can become "n−2" pitches at maximum, the moving time thereof can be greatly shortened in comparison with the moving time for changing a color developer at one end to another at the other end as shown in the conventional system, thereby causing the image formation to be carried out at a much higher speed than before.

This specification specially points out the subject of the invention and ends with the claims clearly claimed. However, this invention can be better understood with the ensuing description with reference to the drawings attached herewith.

DETAILED DESCRIPTION OF THE PREFERRED EMBODIMENTS

Figure 1:
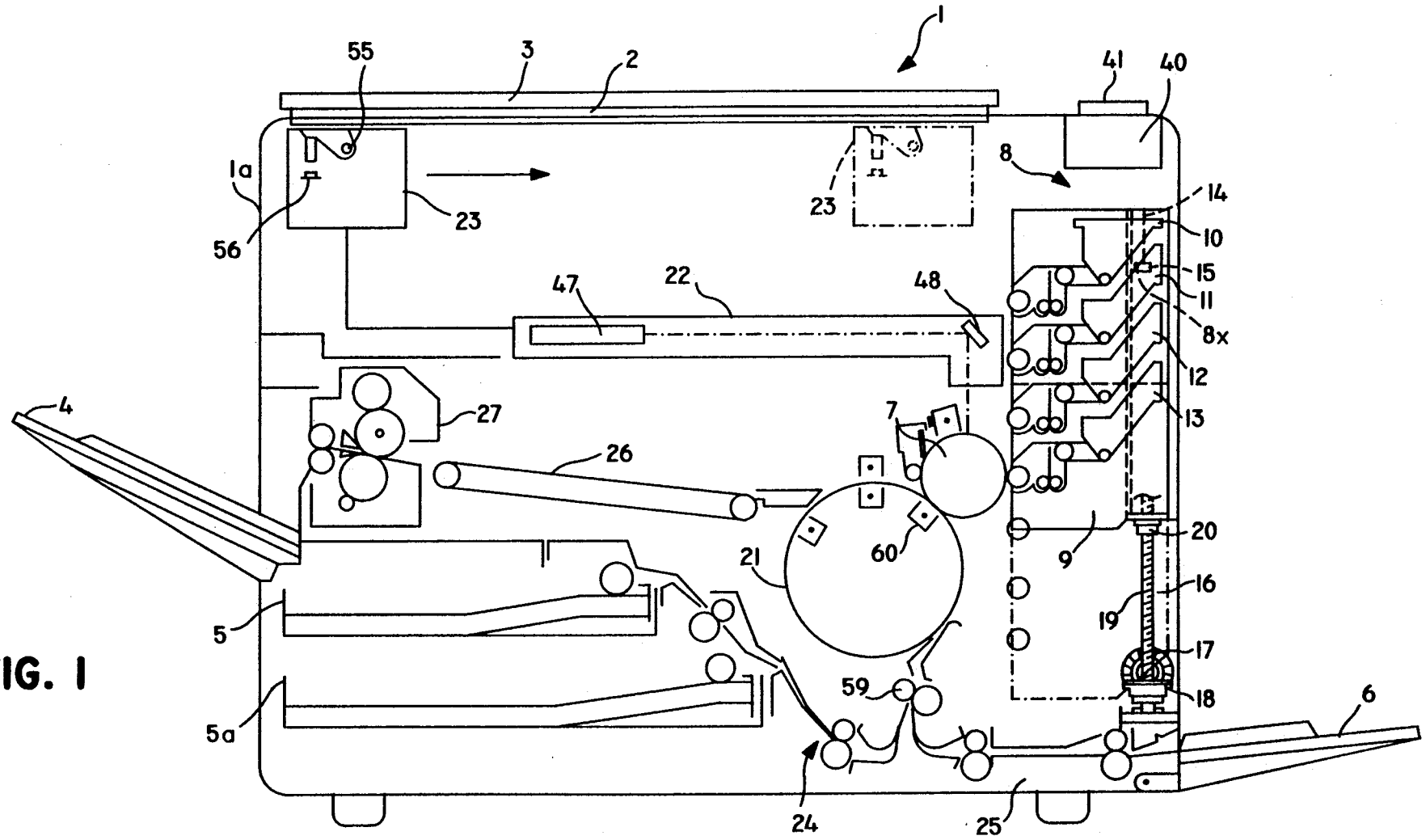
FIG. 1 is a simulated sectional view showing a copying machine which is one of the examples of an image forming apparatus to which the invention is applicable.

FIG. 1 is a sectional view showing a rough composition of a copying machine 1 provided with color copying functions pertaining to one of the preferred embodiments of the invention.

In FIG. 1, a document table 2 on which a document is placed is arranged at the upper part of the copying machine body 1*a*, and a document cover 3 is openably provided on the top of the copying machine body. And at the left side in this Figure a delivery tray 4 and a plurality of paper feeding cassettes 5 and 5*a* are arranged. At the right side thereof, a tray 6 for bypass feeding of paper is placed.

A developing unit 8 integrally including the developers 10, 11, 12 and 13 arranged in a row in the vertical direction is provided at the circumference of the photosensitive drum 7 in addition to an electrification unit, a transfer unit 60, a paper separation unit and a cleaning unit. The arrangement of respective developers is a cyan-color developer 10, a magenta-color developer 11, a yellow-color developer 12 and a black developer 13 in order from the above, and developing agents for developing cyan-color, magenta-color, yellow-color and black are accommodated in respective developers. These developers 10 through 13 are fixed to the moving frame member 9. The moving frame member 9 is vertically movable by a moving mechanism 16. A light shielding plate 14 which gives a reference point 8x for positioning the developer unit 8 in order to compensate for the position of the developer 8 by detecting the home position of the developer unit 8 is fixed at the outer wall of the moving frame member 9. When the developer unit 8 is at the home position thereof, this light shielding plate 14 shields a photo interrupter 15 (FIG. 5) for compensating for the position, thereby causing the detection signal to be outputted.

Namely, the position of this developer unit 8 is compensated when the developer unit 8 which has thus moved is located at the position (shown in FIG. 5(*a*)) where the reference point 8x is detected by the photo interrupter 15 installed at the body of the copying machine 1 as described later. The moving mechanism 16 of the developer unit 8 is composed of a stepping motor 44 (FIG. 2) which can position the developers, a bevel gear 17 linked with the stepping motor, another bevel gear 18 engageable with the bevel gear 17, a ball screw 19 fixed to the bevel gear 18 and extending vertically, a nut 20 fixed to the moving frame member 9 and screwed to the ball screw 19.

A transfer drum 21 is arranged under the photosensitive drum 7 and is so composed that makes one turn per developing color with a transfer sheet electrically adsorbed to the outer circumference thereof. A laser unit 22 is arranged above the photosensitive body 7. The laser beam which comes from a light source 47 of the laser unit 22 is irradiated on the upper end face of the photosensitive drum 7 through a mirror 48. On the other hand, a reader 23 having a CCD sensor 56 and a light source 55 is arranged under the document table 2. The reader 23 is driven in the right and left direction in FIG. 1 and is so composed as to scan a document placed on the document table 2. The image information obtained by the reader 23 is sent out to the laser unit 22 as electric signals.

Paper feeding units 24 and 25 are placed by way of a paper feeding roller 59 among the lower part of the transfer drum 21, the paper feeding cassette 5 or 5a and the tray 6. Each of the paper feedding units 24 and 25 is composed of a paper feeding guide and a plurality of paper feeding rollers.

A paper delivery unit 26 comprising a belt, etc. and an image fusing device 27 comprising a fusing roller, etc. are arranged in order from the side of the transfer drum 21 between the transfer drum 21 and the delivery tray 4.

Figure 2:
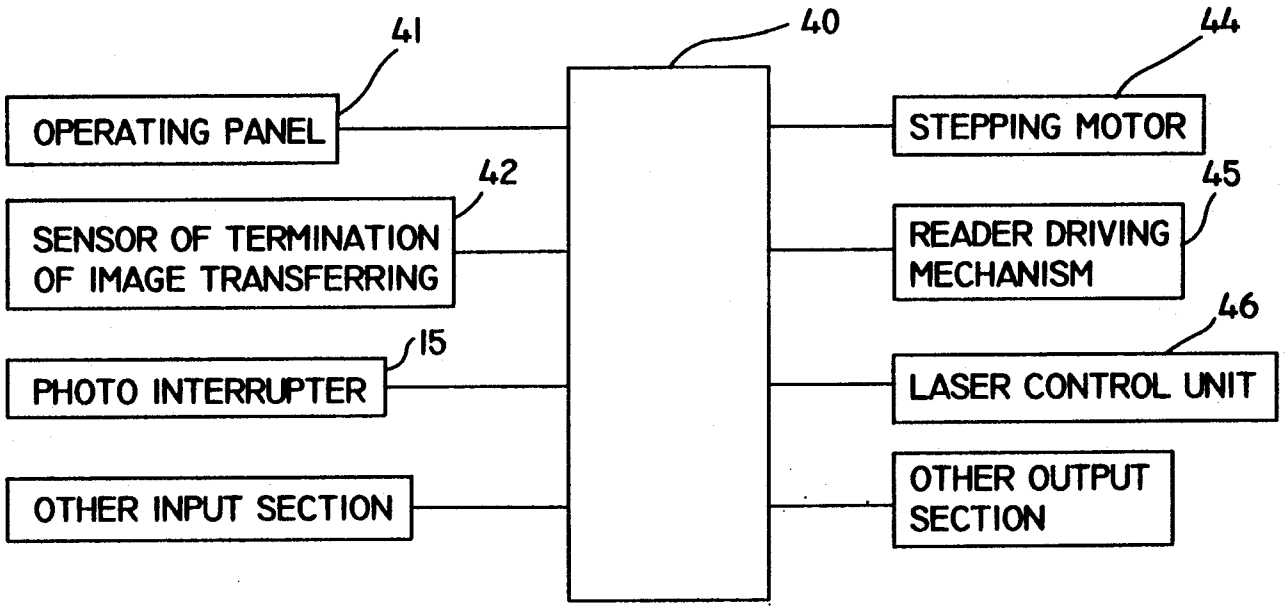
FIG. 2 is a block diagram showing the control of the copying machine.

As shown in FIG. 2, the copying machine has a control section 40 comprising a micro computer composed of CPU (central processing unit), RAM, ROM and etc.. An operating panel 41 placed on the top end face of the copying machine, a sensor 42 of termination of image transferring, which detects the rotation of the transfer drum 21 and detects termination of developing and transferring of each color, a photo interrupter 15, and other inputting section are connected to the control section 40. Also, a motor 44 for driving the moving mechanism 16 of the developer unit 8, a reader driving mechanism 45 for driving the reader 23 and for reading the document image, a laser control unit 46 provided in the laser unit 22 for controlling the laser beam and other outputting section are connected to the control section 40.

According to the operation of the operating panel 41, the copying machine 1 makes copy processing, etc. of a document placed on the document table 2 in compliance with the appointed sequence program memorized in the memory of the control section 40. And the copying machine 1 according to the embodiment of the invention is so composed that it can change the developing colors in a cycle of appointed procedure of magenta-color→cyan-color→yellow-color→black→magenta-color→ . . . when continuously performing four full colors.

Figure 3:
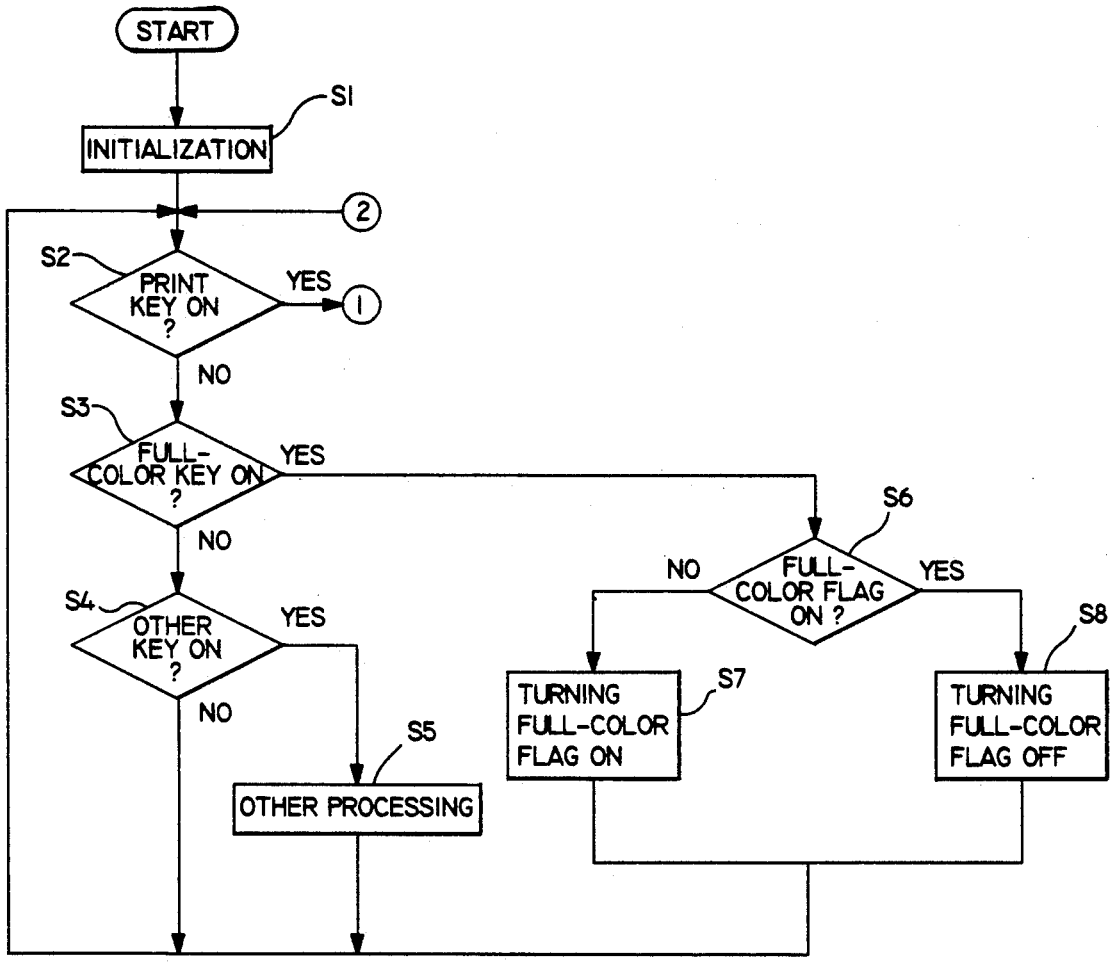
FIG. 3(*a*) to FIG. 3(*c*) are flow charts showing the control of the copying machine.
Figure 3B:
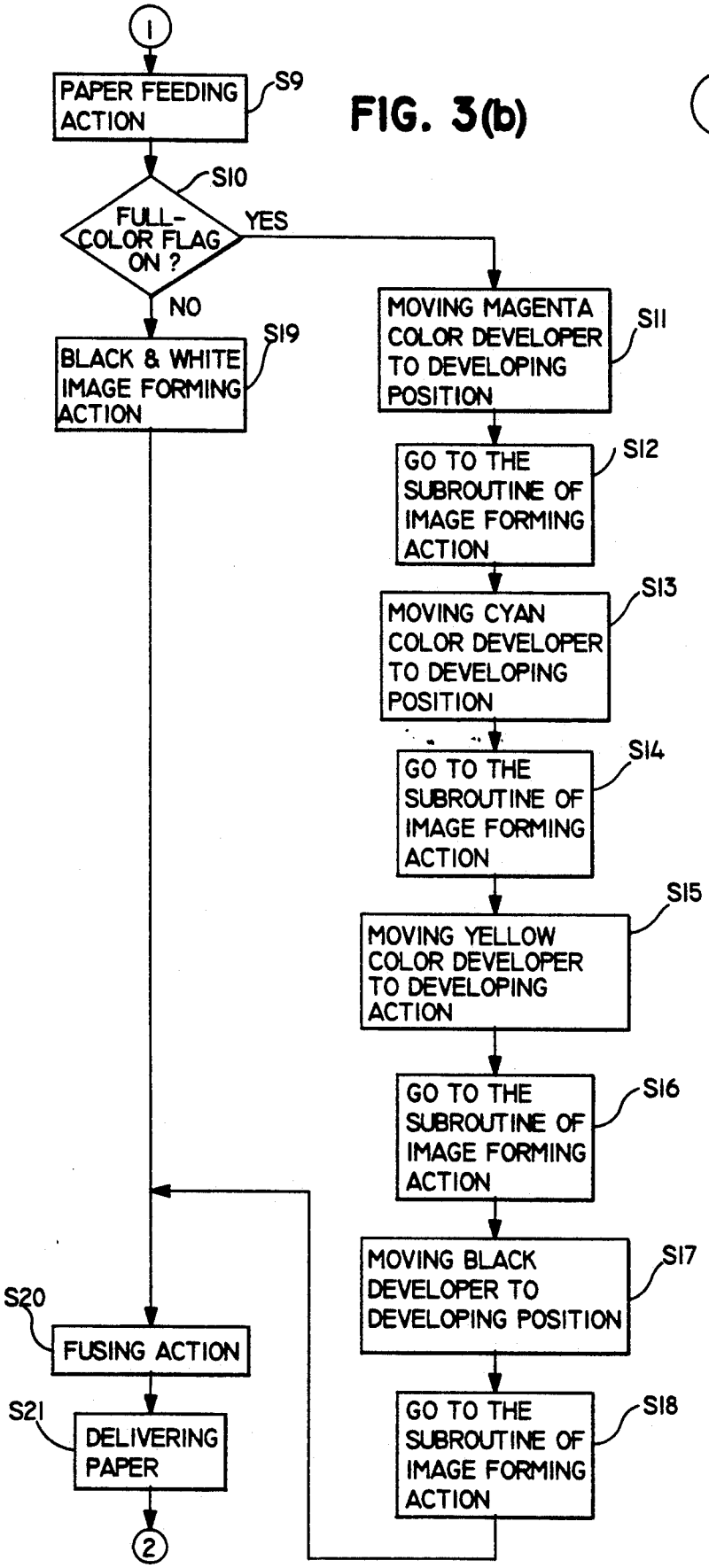
Figure 3C:
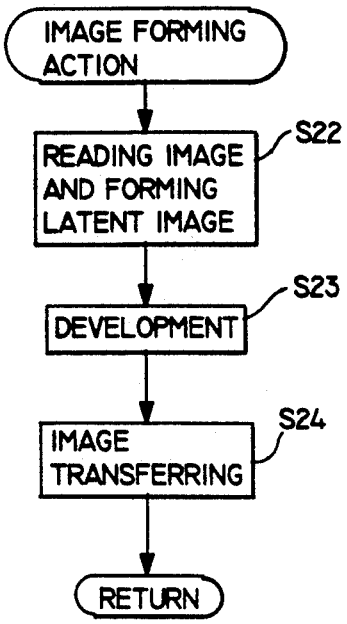
Figures 5A, 5B, 5C, 5D, 5E:
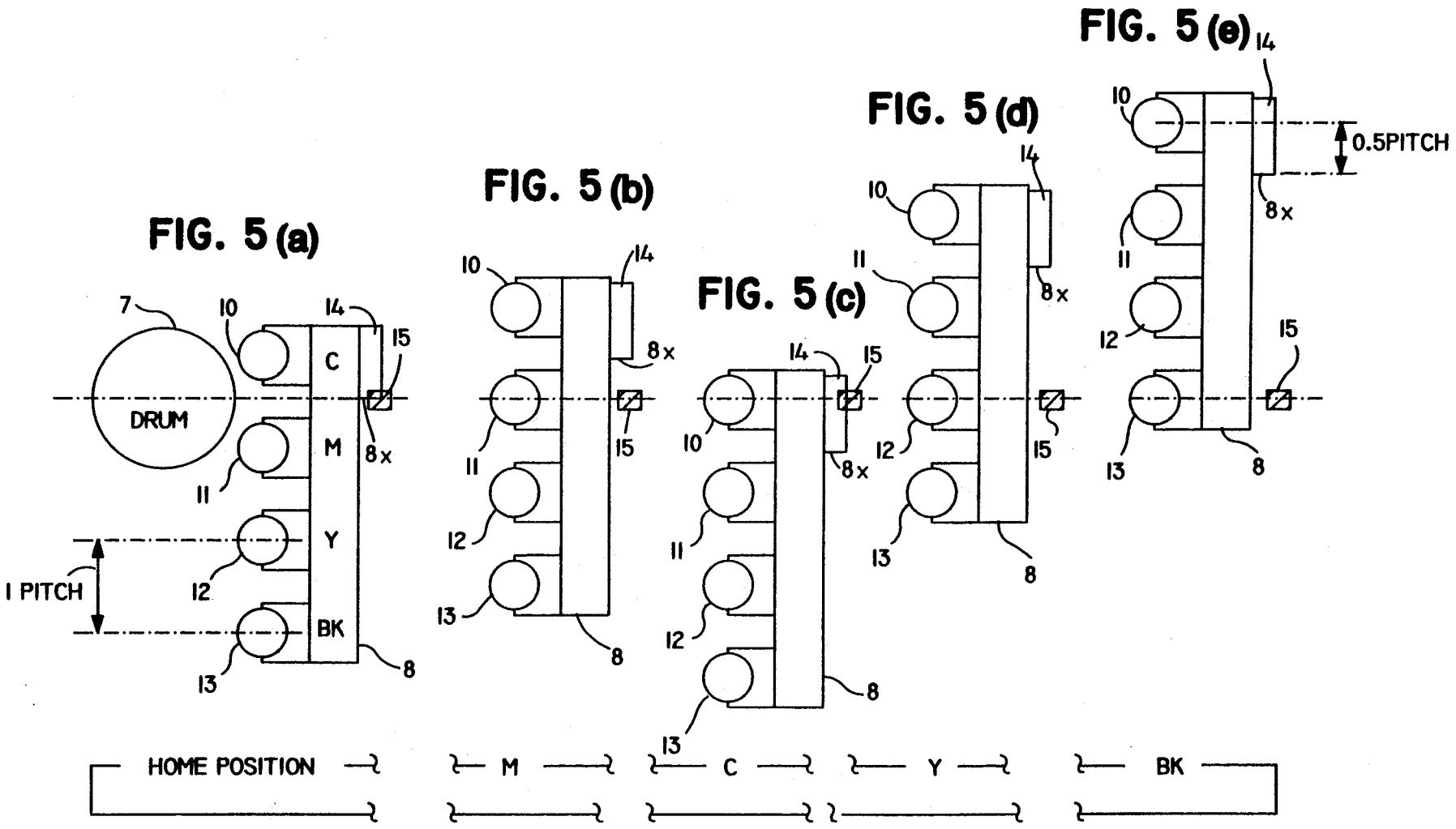
FIG. 5(*a*) through FIG. 5(*e*) are simulated views for explanation of respective examples of the changed statuses of respective developers of the copying machine.

Hence, with reference to FIG. 3(*a*) through (*c*), the processing for forming images like copy processing of the copying machine 1 and the moving processing procedure of the developing unit 8 of the same copying machine 1 are explained in the sequence of step S1, step S2, . . . as concurrently referring to FIG. 1, FIG. 2, FIG. 5((*a*) through (*e*)). Respective flow sheets shown here below are housed in a memory of the control section 40 as sequence program.

When the main switch of the copying machine 1 is turned ON, such an initialization as setting the number of copying sheets to one (1) or setting the developing color to black is carried out in the step S1 in FIG. 3(*a*). In this initialization, the developing unit 8 is placed at the home position shown in FIG. 5(*a*) and indicated by reference point 8x. This home position is detected by the light shielding plate 14 and the photo interrupter 15, and the following control of the movement of the developers is done with this home position regarded as initial position. Next, it is judged in the step S2 whether or not the print key of the operating panel 41 is pressed. It is judged in the step S3 whether or not the full-color key of the operating panel 41 is pressed and in the step S4 whether or not the other key is pressed.

Here, in the case that the full-color key is pressed, the processing goes from the step S3 to the step S6. In this step S6, it is judged whether or not the full-color flag is turned ON. In the case that the full-color flag is turned OFF, the processing goes to the step S7. After the full-color flag is turned ON, the processing goes back to the step S2. In the step S6, in the case that it is judged that the full-color flag is turned ON, the processing goes back to the step S2 after the full-color flag is turned OFF in the step S8.

Now, it is supposed that the full-color copying mode is appointed (namely, the color flag is turned ON) and the print key is pressed. Then, YES is judged in the step S2, the processing goes to the step S9 of FIG. 3(*b*). In this step S9, an appointed transfer sheet is fed from the paper feeding cassette 5 or 5a. The fed transfer sheet is sent onto the transfer drum 21 by the paper feeding unit 24 and the paper feeding roller 59. Next, it is judged in the step S10 whether or not the full-color flag is turned ON, the processing goes to the step S11 where the magenta-color developer 11 moves to the developing position opposed to the photosensitive drum 7. This moving control is made by controlling the angle of rotation of the stepping motor 44 with the control section (40). Also, in the step S11, a filter (not illustrated) provided above the CCD sensor 56 of the reader 23 is changed, and a magenta-color filter is then located above the CCD sensor 56. Under this condition, the processing goes to the step S12 where the sub routine of image forming action is executed.

In the sub routine of image forming action as shown in FIG. 3(*c*), a document image is read in the step S22, thereby causing an electrostatic latent image corresponding to the document image to be formed on the photosensitive drum 7.

The ensuing description copes with this image forming action. As for instance full-color copying processing is started by operating the operating panel 41 after a document is set on the document table 8, light is projected from the light source 55 (FIG. 1), and the light reflected by the document is received by the CCD sensor 56.

The color image information thus received is dissolved into the three primary colors for data processing. The surface of the photosensitive drum 7 is exposed and scanned in accordance with the above image information through the mirror 48 to which light is projected from the light source 47 according to the image information.

As the photosensitive drum 7 is exposed to light while rotating, an electrostatic latent image corresponding to the document image is formed on the surface thereof.

Next, in the step S23, image developing action is performed by the magenta-color developer 11. Consecutively, in the step S24, image transfer is done onto the transfer sheet on the transfer drum 21. Thereafter, the processing returns to the main routine shown in FIG. 3(*b*).

As developing of magenta-color is terminated, the sensor 42 of image transferring detects the termination thereof, and the processing goes to the step S13 where as shown in FIG. 5(*c*) the cyan-color developer 10 is controlled and moves to the developing position said above. Then, in the step S14, the sub routine of image forming action similar to the above magenta-color image forming action is executed by using the cyan-color developer 10. Hereinafter, sequentially in the steps S15 through the step S18, yellow-color developing is done by using the yellow-color developer 12 and black developing is done by using the black developer 13, thereby causing toner image corresponding to respective colors to be transferred to the transfer sheet on the transfer drum 21. As the black developing is terminated, the processing goes to the step S20, wherein fusing action similar to the conventional way is carried out. Consecutively, the processing returns to the step S2 of FIG. 3(*a*) after paper delivery action is performed in the step S21. Also, the filters of respective colors are controlled and changed as soon as the moving control is done for each of the developers.

Thus, a transfer sheet transferred with full colors is obtained on the delivery tray 4.

Next, in the case that a black and white copying mode is appointed (namely, when the full-color flag is turned OFF), the judgement in the step S10 becomes NO, the processing goes to the step S19, where usual black and white developing and image forming action by transferring action are performed. And a transfer sheet copied in black and white is obtained on the delivery tray 4 through the processing in the steps S20 and S21.

Figure 4:
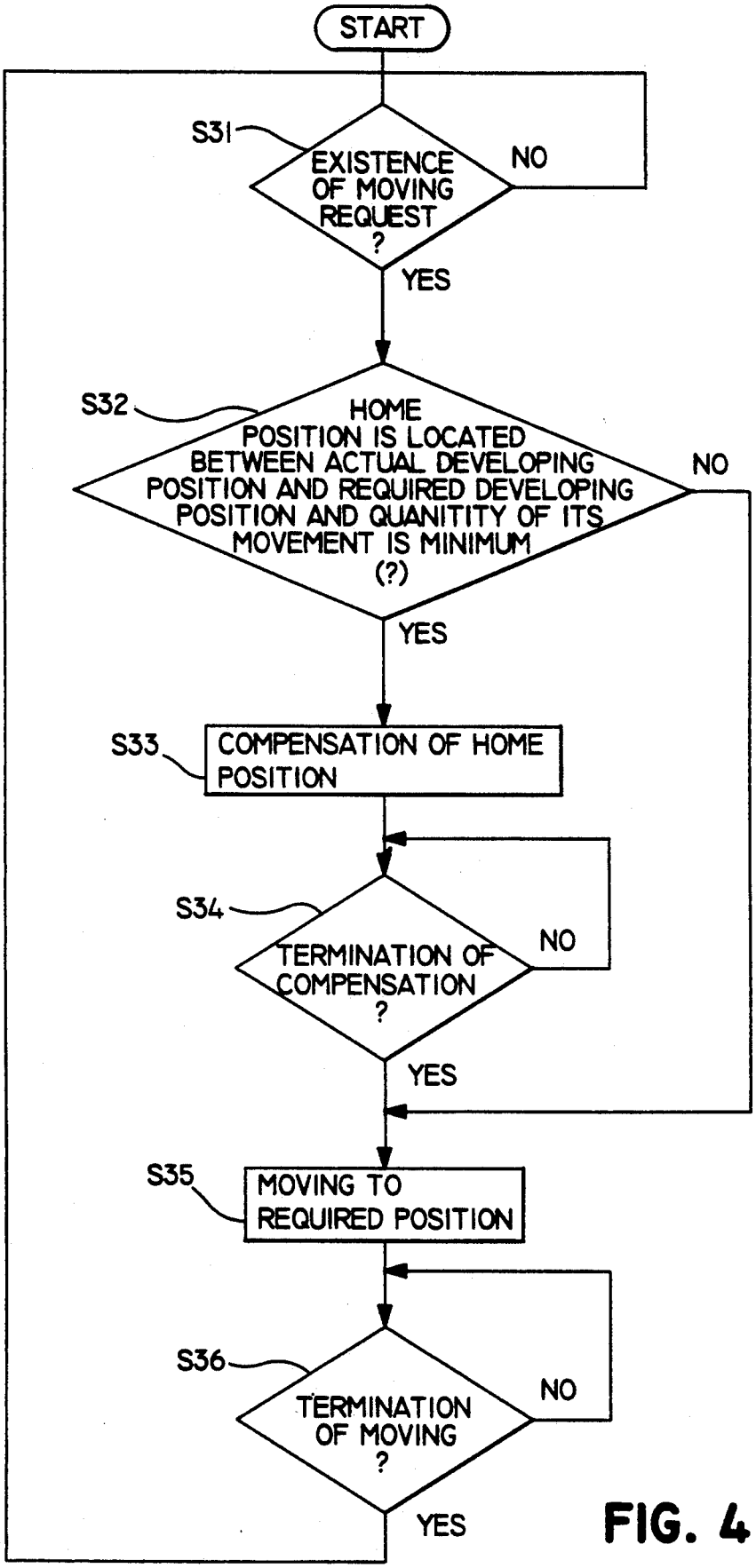
FIG. 4 is a flow chart showing the processing procedure for compensating the position of the developers of the copying machine.

Next, the processing procedure for compensating the position of the developer unit 8 of this copying machine 1 is explained in the sequence of the steps S31, S32, . . . with reference to FIG. 4 together with FIG. 1, FIG. 2 and FIG. 5.

In the case that in the above image forming action the image information read by the CCD sensor 56 corresponding to the document image is, for example, "Yellow-color" image data of the three primary colors and the developer of the developer unit 8 opposed to the photosensitive body of the photosensitive drum 7 at present is for example a developer 13 in which "black" toner is accommodated (FIG. 5(*e*)), a moving request signal by which the developer unit 8 is to be moved in order to change the developer to the developer 12 accommodating "Yellow-color" toner corresponding to the color information of the image data is outputted from the control section 40 (Step S31).

At this time, as the reference point 8*x* for compensating for the position of the developer unit 8 does not exists on the shortest path between the developer 13 and the developer 12 (S32), the developer unit 8 is moved by the stepping motor 44 for positioning (S35), and the developer 12 is opposed to the photosensitive body of the photosensitive drum 7(S36) (FIG. 5(*d*)), the position of the developer unit 8 is not compensated and the electrostatic latent image is developed to a toner image of "Yellow-color".

As mentioned above, as the developer unit 8 is moved by the stepping motor 44 for positioning and the developer 12 of the developer unit 8 is so positioned that it can be opposed to the photosensitive body, not only is no stopper mechanism that has been conventionally employed needed anymore, but also the position accuracy can become much higher than that in any conventional systems and the toner image can be composed of a higher quality because the stepping motor 44 itself can be controlled by pulse control and can rotate at a high accuracy.

On the other hand, a transfer sheet which is supplied through the upper paper feeding cassette 5, the lower paper feeding cassette 5*a* or the tray 6 is sent to the photosensitive drum 7 through the paper feeding roller 59, etc., and the toner image is transferred to the transfer sheet when it passes through in the vicinity of the transfer section 60.

The transfer sheet on which the toner image is transferred is further rotated by the transfer drum 21 and is again sent to the photosensitive drum 7.

In the case that the color of image information to be processed next is, for example, "Cyan-color", a moving request signal by which the developer unit 8 is moved so that the developer 12 opposed to the photosensitive body of the photosensitive drum 7 can be changed to the developer 10 accommodating a toner of "Cyan-color" is outputted from the control section 40 (S31).

In this case, as the reference point 8*x* exists on the shortest moving path between the developer 12 and the developer 10 (S32), the reference point 8*x* is detected by the photo interrupter 15 when the developer unit 8 moves on the most short-cut moving path. In this case, the moving path is the shortest moving path of the developers 12→11→10, but it is not, for example, the moving path of the developers like 12→13→12→11→10. And the position of the developer unit 8 is compensated (S33) (FIG. 5(*a*)). As this position compensating is completed (S34), the developer unit 8 is further moved (S35). Thereafter, the developer 10 is opposed to the photosensitive body of the photosensitive drum 7 (S36) (FIG. 5(*c*)). Therefore, the color of the toner image to be transferred when the transfer sheet passes through the transfer section 60 becomes "Cyan-color".

In this copying machine 1, when one developer is changed to another developer as aforementioned, the position of the developer unit 8 is compensated at the appointed compensating position (the reference point 8x) only in the case that the compensating position (reference point 8x) exists on the shortest moving path.

Therefore, even though any positioning error should result from such mechanical factors as gear and backlashes, etc., the positioning error can be compensated at once, thereby causing the positioning accuracy of the developers of the developer unit 8 to be highly maintained. In addition, since the position of the developer unit 8 is compensated only when reference point 8x is on the shortest moving path, it can exclude any wasted time.

The development and transfer processing similar to the aforementioned can be carried out for the other remaining colors.

Therefore, the image formed on the transfer sheet is made beautiful and is free from any imbalance or unevenness of density.

And as the transfer processing ends, the transfer sheet is subjected to fusing processing in the image fusing unit 27 by way of the paper delivery unit 26 and is delivered to the paper delivery tray 4.

Also, though a stepping motor 44 is used as motor for positioning in this preferred embodiment of the invention, other motor having the similar function, for example, a DC servo motor can be used.

Also, in the aforementioned embodiment of the invention, the description copes with the case that the position of the developer unit 8 is compensated when the developer unit 8 passes through the compensating position on all of the shortest moving paths with the example of the changing path of "Yellow-color" of the developer 12 and "Cyan-color" of the developer 10 taken for instance. The shortest moving path is applicable even though limited to the case that the developer unit 8 moves between any optional developers, for example, the adjacent developers.

For instance, in the example shown in FIG. 5, as the reference point 8x of the developer unit 8 exists between the adjacent developers 10 and 11, the most short-cut moving path of this case is the case of moving from the developer 10 to the developer 11 or the case of moving from the developer 11 to the developing 10. In the case that the reference point 8x exists at other position, for instance, between the adjacent developers 11 and 12, the shortest moving path is then the case of moving from the developer 11 to the developer 12 or the case of moving from the developer 12 to the developer 11 as well.

Even though the developer unit 8 moves even at a low speed for heightening the positioning accuracy thereof if the adjacent developers are selected to define the shortest moving path as aforementioned, the positioning and the position compensating thereof can be done in a short time, thereby causing the efficiency of the position compensating to be further heightened.

As aforementioned, the copying machine according to the preferred embodiment of the invention can more heighten the positioning accuracy of the developers than in any of the conventional systems and can highly maintain the positioning accuracy of the developers without any waste time.

In the aforementioned embodiment of the invention, the development is made at magenta-color, cyan-color, yellow-color and black in this order when copying with full colors. A developer of "cyan-color" is placed on the top, and other developers of "Magenta-color", "Yellow-color" and "Black" come after the developer "cyan-color", in this order. For this reason, as the developer unit moves by two pitches at maximum, the copying speed is more accelerated in comparison with any conventional full-color development for which developers move by three pitches. Furthermore, the load of the motor for moving developers can be lightened, thereby causing the motor to be small-sized. Accordingly, the cost of production can be reduced.

And two developers are used for developing mono-color development of RED(R), GREEN(G) or BLUE(B). In this embodiment, even in the case that the mono-color development is performed, the developers move only by two pitches at maximum, thereby causing the copying speed to be accelerated. Namely, when copying with mono-color (Red), a magenta-color developer 11 and a yellow-color developer 12 are used. For green, a cyan-color developer 10 and a yellow-color developer 12 are used. For blue, a cyan-color developer 10 and a magenta-color developer 11 are used. In these cases, the developers move only by two pitches at maximum.

Figure 6:
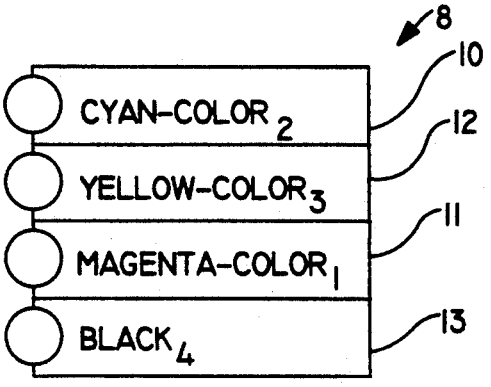
FIG. 6(*a*) through FIG. 6(*c*) are views showing the arrangement of the developers according to another example of the embodiments of the invention.
Figure 6:
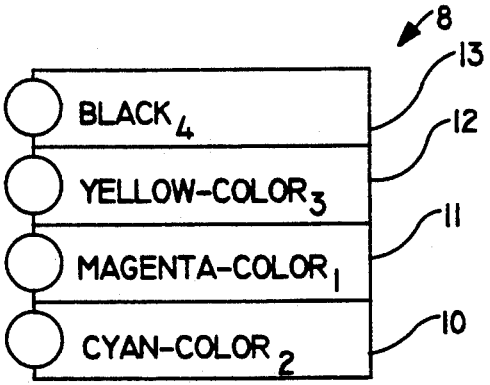
Figure 6:
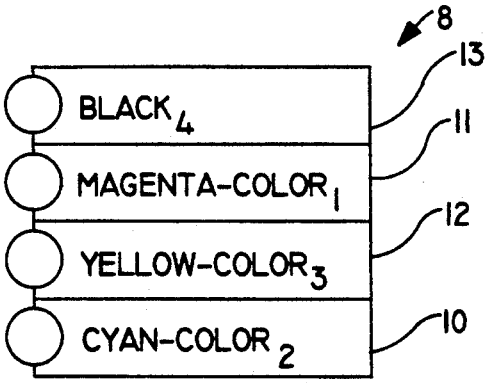
Figure 7:
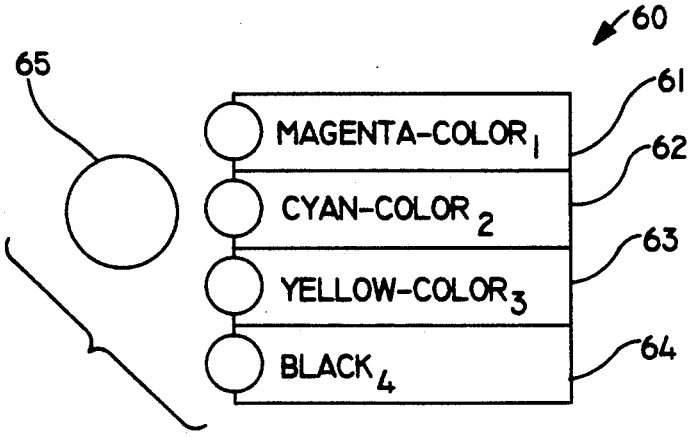
FIG. 7 is a view showing the conventional machine pertaining to the developer unit of a color copying machine.

In the aforementioned embodiment of the invention, respective developers are arranged to be for cyan-color, magenta-color, yellow-color and black from the above in this order. However, other arrangement of the developers is also possible as shown in FIG. 6(*a*) through (*c*). In this case, it is enough that the developers move by only two pitches at maximum.

Also, in the embodiments of the invention, which are shown in FIG. 1 and in FIG. 6(*a*) through (*c*), such a arrangement of the developers as the maximum moving distance can be of two pitches is employed under a premise of copying with full-color and with a mono-color Red, Green or Blue. In the case that the mono-color copying (Red, Green or Blue) is not taken into consideration, still another arrangement of the developers is available, too.

Furthermore, in the embodiments of the invention, the arrangement of the developers is so made as shown in FIG. 1 and FIG. 6(*a*) through (*c*) while the developing sequence is magenta-color, cyan-color, yellow-color and black. In the case the developing sequence is different from the aforementioned case, the developers can be set and arranged so that the maximum moving distance of the developers can be of two pitches.

In each of the embodiments mentioned in the above, the invention applies to such a type that four developers can be arranged in the vertical direction and can move vertically. However, the invention can be adopted to such a type that a plurality of developers can be arranged in a row in the horizontal direction and can make reciprocatory actions.

And the aforementioned embodiments deal with full-color copying by using four developers. However, if respective developers are so arranged that the maximum moving distance thereof can be of ("n"−2) pitches when full-color copying is performed by generally using developers of "n" (n is a number more than 4) sets, the moving time of the developers can be shortened in comparison with any conventional system.

As described in the above, by properly setting the arrangement of the developers according to the developing sequence when making multi-color developing according to the invention, the moving time of the developers can be shortened and the image forming speed can be increased. In the case that the image forming speed is set to the same level as that in the conventional system, the size of motor can be much reduced.

The invention can be carried into effect and embodied in various examples of the embodiment thereof without departing from the spirit and substantial features thereof.

Therefore, though the aforementioned embodiment is a preferable one, it can be understood that the invention is not limited to the preferred embodiment and that various modifications which can be made in the scope of the claims described hereinafter and the scope meant by the claims are all included in the claims hereof.

What is claimed is:

1. An image forming apparatus comprising:

a plurality of developers;

a motor for changing a developer opposed to a photosensitive body by integrally moving the corresponding developers; and a means for adjusting a position of the corresponding developer at a predetermined adjusted position thereof during movement of the corresponding developer;

said image forming apparatus further characterized in that:

the developers are moved through the shortest moving path from one developer to a next selected one of said plurality of developers; and the position of developers is adjusted only when the predetermined adjusted position is on said shortest moving path when one of the plurality of developers is changed to another developer.

2. An image forming apparatus comprising:

a plurality of color developers of a number n, wherein n is a number more than 4 which are arranged in a row in one direction;

a means for changing a color developer opposed to a photosensitive body by moving corresponding color developers in each of said number n;

a means for controlling the moving sequence of the plurality of color developers of said number n to form a color image of a document on a transfer sheet; and a means for adjusting a position of the developers at a predetermined adjusted position thereof during changing of the developers;

said image forming apparatus further characterized in that;

the color developers of said number n are arranged according to a moving sequence such that a moving distance of each of said color developers is n pitches at a maximum;

the developers of said number n are changed through a shortest moving path when one of the plurality of developers of the number n is changed to another developer; and the position of the number n of plurality of developers is adjusted only when the predetermined adjusted position is on said shortest moving path.

3. An image forming apparatus according to claim 1 wherein said motor is a stepping motor.

* * * * *

UNITED STATES PATENT AND TRADEMARK OFFICE

CERTIFICATE OF CORRECTION

PATENT NO. : 5,293,206

DATED : March 8, 1994

INVENTOR(S) : Takao Ichihashi et al.

It is certified that error appears in the above-identified patent and that said Letters Patent is hereby corrected as shown below:

On the title page, Items

[54] In the Title:

Change "COLOR IMAGE FORMING APPARATUS WITH OPTIUM OPERATION OF DEVELOPING DEVICE POSITIONING MECHANISM" to --COLOR IMAGE FORMING APPARATUS WITH OPTIMUM OPERATION OF DEVELOPING DEVICE POSITIONING MECHANISM--.

[75] change the address of the last inventor, YASUYUKI FUKUNAGA, from "OSKAK" to --Osaka--.

[30] Foreign Application Priority Data:

Change "Jul. 11, 1989 [JP] Japan ..... 1-289679
Sep. 19, 1989 [JP] Japan ..... 1-256665"

to --Nov. 7, 1989 [JP] Japan ..... 1-289679
Sep. 29, 1989 [JP] Japan ..... 1-256665--.

Signed and Sealed this

Fifth Day of July, 1994

*Attest:*

Bruce Lehman

BRUCE LEHMAN

*Attesting Officer*

*Commissioner of Patents and Trademarks*